United States Patent [19]

Blackburn et al.

[11] Patent Number: 5,005,216

[45] Date of Patent: Apr. 9, 1991

[54] SELF-VENTILATING PROTECTIVE GARMENT

[75] Inventors: William A. Blackburn, Cary, N.C.; Michael P. Sosnowich, Decatur, Ala.

[73] Assignee: Abandaco, Inc., Decatur, Ala.

[21] Appl. No.: 559,681

[22] Filed: Jul. 30, 1990

[51] Int. Cl.[5] ..... A62B 17/00; A41D 13/00

[52] U.S. Cl. ..... 2/79; 2/84; 2/171.3; 2/2; 2/2.1 A; 2/DIG. 1; 128/201.29

[58] Field of Search ..... 2/79, 84, 171.3, DIG. 1, 2/2, 2.1 A; 128/201.29

[56] References Cited

U.S. PATENT DOCUMENTS

| | | | |
|---|---|---|---|
| 3,529,594 | 9/1970 | Charnley | 2/2 |
| 4,146,933 | 3/1979 | Jenkins et al. | 2/79 |
| 4,271,833 | 6/1981 | Moretti | 2/DIG. 1 |
| 4,272,851 | 6/1981 | Goldstein | 2/79 |
| 4,914,752 | 4/1990 | Hinson et al. | 2/79 |

*Primary Examiner*—Werner H. Schroeder
*Assistant Examiner*—Gloria Hale
*Attorney, Agent, or Firm*—Olive & Olive

[57] ABSTRACT

A protective garment is fed pressurized air through a hood piece connected to a pressurized air source and expels the air through air breather panels formed in the lower leg portions of the garment to prevent ballooning of the garment.

7 Claims, 3 Drawing Sheets

SELF-VENTILATING PROTECTIVE GARMENT

BACKGROUND OF INVENTION

1. Field of the Invention

The invention relates to protective garments and more particularly to protective garments of the type having a hood covering the operator's head and fed by a pressurized air supply.

2. Background of the Invention

Protective apparel is being increasingly required for certain working conditions by governmental regulation. One type of protective garment known as a sack suit incorporates a hood for the operator's head. The hood connects to a flexible hose which in turn connects to a air source of breathing quality air. In using this type of protective garment, the worker pulls open the neck of the sack suit wide enough to step into the suit through the neck. An elastic band in the neck is designed to allow the neck area to be stretched wide enough to allow this entry and to recover to partially close the neck. Before closing the neck, the worker dons an air hood and fits the inner skirt of the hood inside the neck of the suit and then uses a draw string to close the neck of the suit and lock it over the inner skirt of the hood. The outer air hood skirt is then fitted over the sack suit on the outside with the upper neck portion of the sack suit effectively held between the inner and outer skirts of the hood. In this type of sack suit, the operator also fits each hand into a glove-shaped hand cover forming an extension of an inner skirt secured within the outer extremity of the arm section. The operator then dons a heavy work glove over each hand and fits the upper extremity of each glove within the outer extremity of the arm section and over the inner arm skirt to which the hand cover is secured. When donning the suit, the operator also typically fits each of his street shoes into a substantially air impervious shoe cover which is formed as an extension of an inner skirt within the outer leg section at the lower extremity of each leg section of the suit. The operator's work boots are then donned over the shoe covers and the upper portions of the boots are fitted between the inner leg skirt and outer leg section. Elastic straps at the extremity of each arm section and at the extremity of each leg section maintain the suit fabric in a secured position around the prospective work gloves and work boots of the operator.

Sack suits of the type described have been made by Abandaco, Inc. of Decatur, Ala. and by the Durafab Company of Cleburne, Tex. by way of example. The suit and hood fabric as well as the fabric employed for the inner hand covers and shoe covers have generally been made of a material which is substantially impervious to air. Thus, when a sack suit of the type described is used with a hood and a 20 pressurized air source as mentioned above, the suit tends to trap air from the hood in the sack suit and to expand the suit under a positive pressure so that the worker is inhibited in his work. Such suits when associated with a pressurized air source as described often tend to balloon outward and become so large that a worker's dexterity is inhibited. Various ventilating systems have been employed as, for example, in the system of U.S. Pat. No. 4,914,752. Valves have been found unacceptable because of tending to breathe in particulates. However, there is a need to provide an improved protective garment suitable for use with a pressurized air source connected to a hood but which does not tend to balloon in the manner described. The provision of an improved totally encapsulating suit with a pressurized air source in a manner such that the suit does not tend to balloon and provides a better control of the cooling effect of the air is the primary object of the invention. Other objects will become apparent as the description proceeds.

SUMMARY OF THE INVENTION

An improved totally encapsulating suit according to the invention is formed of an outer, impermeable protective layer and is adapted to be used with a pressurized air source. The air pressure is relieved and thus ballooning is eliminated by incorporating at the bottom of each leg of the garment and within a protective skirt a panel formed of an air porous fabric through which the air fed into the suit can be expelled so as to constantly reduce the pressure and provide a level of pressure that insures comfortable breathing and a desired cooling effect of the air while eliminating the mentioned ballooning effect. Sealed seams are used throughout to enhance the degree of protection.

While this improvement in protective apparel has been specifically described for a suit with a separate helmet and sack suit design, it is also suitable for integral, one-piece suits. A popular one-piece suit is typified by a sealed seam version of Abandaco's style 1501 suit which is supplied with breathing quality air through an attachment at the wearer's waist. This particular suit is manufactured for a laminate of 2 mil. thick Saranex TM 23P film which has been bonded to style 1422A Tyvek TM using a 1 mil. thick ethylene vinyl acetate binder film. This suit is a coverall design with a zipper, storm flap, nylon visor, hood, elastic wrist and boots. The breathing fabric panel is inserted under a skirt of the Saranex TM 23P/Tyvek TM fabric below the knee and terminates at the ankle. From the ankle down the suit is constructed, again, of the Saranex TM 23P/Tyvek TM fabric. The covering skirt over the breather panel is fitted with elastic to bring the outer fabric into a loose fitting contact with the boot section of the suit. A variation of this suit is to follow the same design of that described in the sack suit version where the suit is worn with separate chemically resistant boots.

DESCRIPTION OF THE PREFERRED EMBODIMENT

Figure 1:
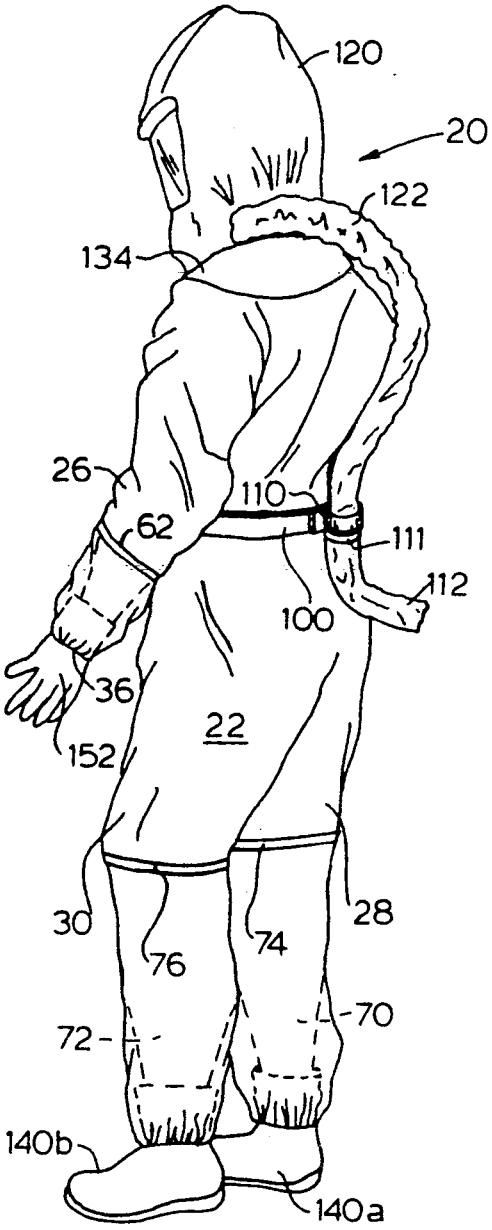
FIG. 1 is an elevation view of an operator fitted with a self-ventilating protective garment and removeable air hood assembly according to the invention.

Making reference to the drawings, a protective garment assembly 20 according to the invention comprises a so-called sack suit 22 portions of which cover the torso and other portions of which form arm sections 24, 26, leg sections 28, 30 and a neck portion 32. The sack suit is typically made of a barrier fabric or impermeable layer such as polyethylene coated Tyvek TM fabric or a polyvinyl chloride (PVC) coated nylon fabric. Arm sections 24, 26 are provided at their extremities with elastic wrist bands 34, 36 and leg sections 28, 30 are provided at their extremities with elastic ankle bands 40, 42. A drawstring 50 enables neck portion 32 to be tightened.

Arm sections 24, 26 have respective inner arm skirts 52, 54 made of the same type barrier fabric as sack suit 22 and which extend from the location of the respective elastic wrist bands 34, 36 to respective joints 60, 62 below the elbow area where the upper wrist peripheral ends of the inner arm encircling skirts 52, 54 are suitably joined or bonded to the inner surface of the outer arm fabric. Hand and finger covers 64, 66 made, for example, of a soft at least slightly air porous knit fabric are joined to the outer extremities of the inner arm skirts 52, 54.

In a similar construction, leg sections 28, 30 have respective inner leg skirts 70, 72 made of the same type barrier fabric as sack suit 22 and which extend from the location of the respective elastic ankle bands 40, 42 to respective joints 74, 76 below the knee area where the upper ends of the inner leg encircling skirts 70, 72 are suitably joined or bonded to the inner surface of the outer leg fabric.

Of particular significance to the present invention, street shoe covers 80*a*, 80*b* made of an air porous fabric are joined to the outer extremities of the inner leg encircling skirts 70, 72. The lower leg panels in one embodiment were made from a microporous, acrylic, foam coated, spunbonded polypropylene fabric. This type fabric is sold as Enhance fabric by PFG of Greensboro, N.C. The lower leg panels, in effect, form breathing panels which relieve the excess pressure within the sack suit 22 and thereby prevent the ballooning effect previously referred to and while providing improved control of the flow of the air to provide enhanced wearer cooling and comfort.

A spunbonded polypropylene fabric sold under the trademark Polybond by the Waynetex Company, a spunbonded nylon fabric sold under the trademark Cerex by the James River Company and a spunbonded polyester fabric sold under the trademark Reemay by Reemay, Inc. represent examples of other fabrics deemed suitable for forming the breather panels. A fabric having a porosity of 30 to 400 cubic feet per minute per square foot (CFM/ft$^2$) as measured by a Frazier permability measuring device is deemed suitable with a porosity near 100 CFM/ft$^2$ being preferred.

Figure 2:
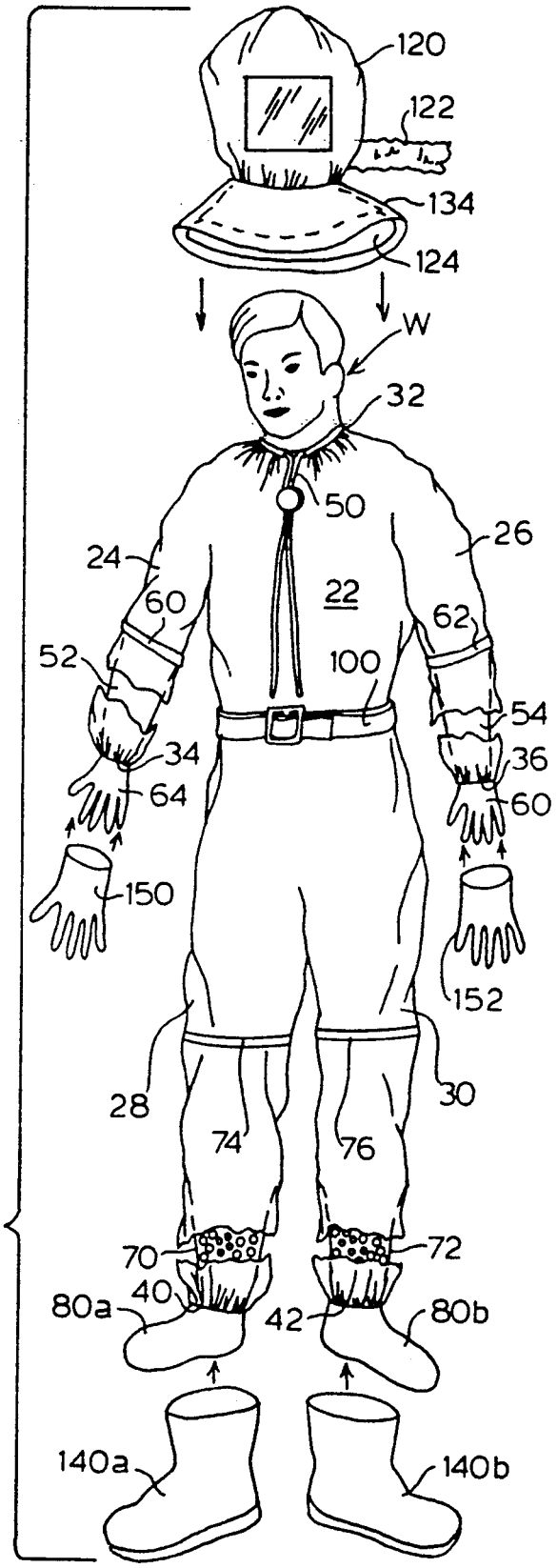
FIG. 2 is a view similar to FIG. 1 but without the air hood assembly.
Figure 6:
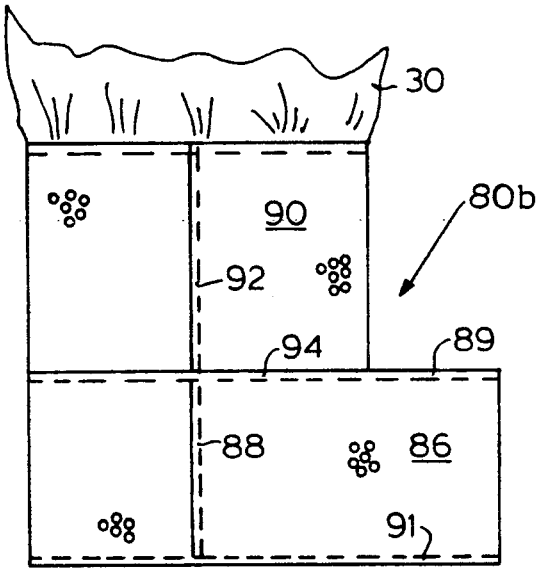
FIG. 6 is a side elevation view of the self-ventilating street shoe cover according to a first embodiment of the invention.
Figure 7:
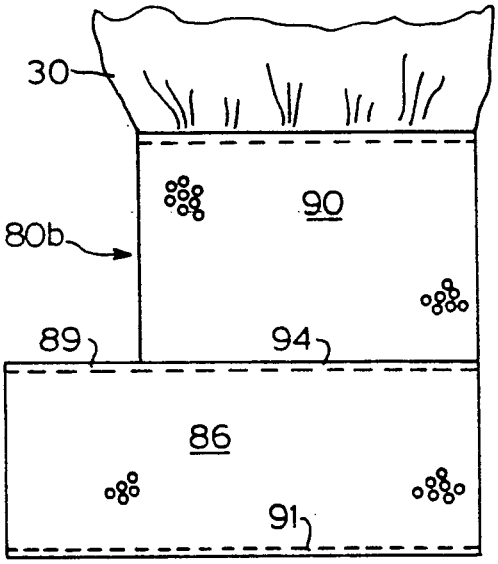
FIG. 7 is a side elevation view similar to FIG. 6 but taken from the opposite side of the street shoe cover.

In a first embodiment illustrated in FIGS. 6 and 7 each lower leg panel is formed from an air porous fabric panel 86 having its edges joined by a vertical seam 88, a top seam 89 and a bottom seam 91. Fabric panel 86 is in turn joined to a second panel 90 having edges joined together by vertical seam 92 and joined to the lower panel 86 by seam 94 to form the generally boot shape street shoe covers 80*a*, 80*b* seen in FIG. 2.

Figure 3:
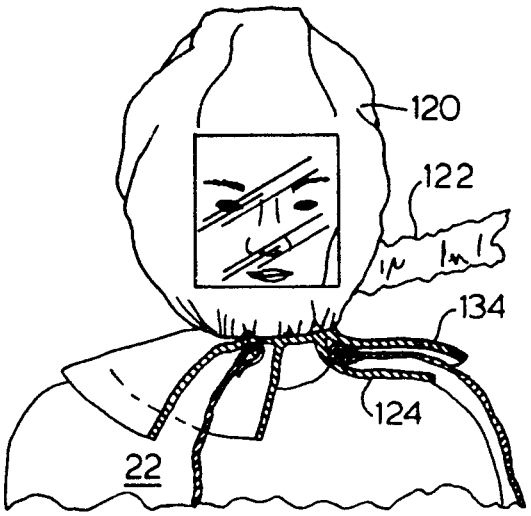
FIG. 3 is a diagramatic front elevation view of the air hood assembly installed on the operator.
Figure 4:
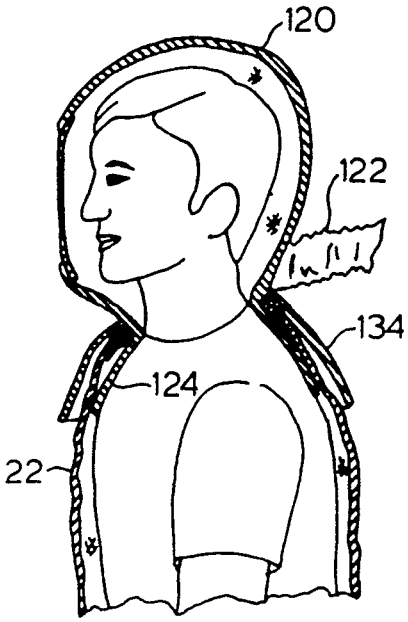
FIG. 4 is a diagramatic side elevation view of the air hood assembly installed on the operator.

In use, the worker W typically wearing street clothing 77 (FIG. 5) and street shoes 79 (FIG. 5) pulls open the neck of the sack suit 22 wide enough to step into the suit through the neck. The elastic band 32 in the neck is designed to allow this entry and will recover to partially close the neck. Before closing the neck, worker W dons belt 100 having clip 110 which connects flexible air hose 122 thereto at the waist. Air hose 122 connects to hood 120 by means of a suitable connection fitting (not shown). Before closing the neck, worker W dons the air hood 120 and fits inner hood skirt 124 inside the neck of suit 22 as in FIGS. 3 and 4 and then uses drawstring 50 (FIG. 2) to lock inner hood skirt 124. The outer hood skirt 134 is then fitted over the sack suit 22 on the outside which effectively sandwiches the sack suit neck portion between the inner 124 and outer 134 hood skirt. Air supply line 112 is then removably attached to air hose 122 by quick disconnect fittings 111.

Figure 5:
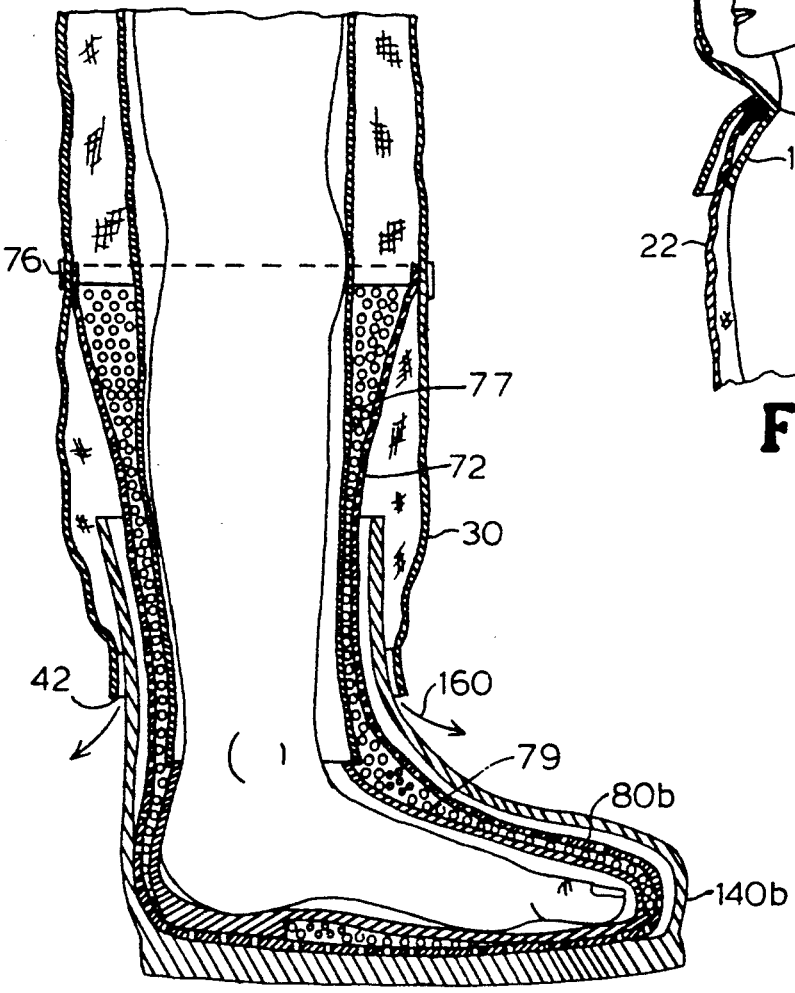
FIG. 5 is a diagramatic elevation view of one lower leg portion of the invention garment showing its relation to the operator's foot, street shoes and work boot.

Worker W fits his street shoes into the shoe cover portion of the suit 80*a*, 80*b* after which the worker's work boots 140*a*, 140*b*, typically in the nature of soft, rubber outer boots, are pulled up over the street shoe covers 80*a*, 80*b*. The upper portion of the work boots are arranged as seen in FIG. 5 so as to partially enclose the end of breathing panels 70, 72 and be covered by the lower extremities of the outer leg sections 28, 30 held by the elastic ankle bands 40, 42. At the same time the worker fits his hands into the hand and finger covers 64, 66 and then pulls his work gloves 150, 152 into place over the inner arm skirts 52, 54 and beneath the outer extremities of the arm sections 24, 26 as in FIG. 1 to be held by the elastic wrist bands 34, 36.

Once the air supply (not shown) begins to operate, air will be forced downward over the worker's body to the air breather panels formed by the lower leg panels 80*a*, 80*b* and will then be forced out at the lower leg extremeties as indicated by the arrows 160 in FIG. 5.

Figure 8:
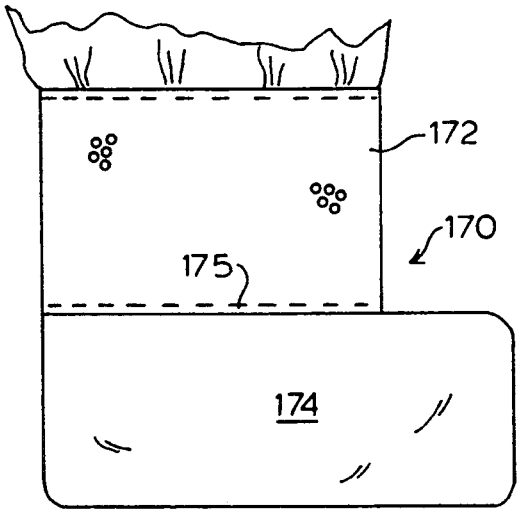
FIG. 8 is a side elevation view of the street shoe cover in a second embodiment of the invention.

In an alternative embodiment, illustrated in FIG. 8, the street shoe covers 170 are formed with an upper breather panel 172 made of air porous fabric and a lower street shoe cover 174 made of another non-air porous water repellant shoe cover fabric such as Tyvek TM.

In summary, a self-ventilating garment has been provided which tends to not balloon and provide a steady, satisfying flow of air over the worker. Any level of pressure desired in the suit may be obtained by adjusting either the size of the panel or the permeability of the breathing panel fabric, or both while maintaining a desired air flow rate to the hood.

We claim:

1. An air ventilated protective garment for an operator working in a hazardous environment, comprising:

(a) an outer impermeable protective layer having portions covering the torso, the arms to the wrists and the legs to the ankles and having an interior surface, an exterior surface and a neck area;

(b) securing means including elastic band means formed around the respective neck area, wrist and ankle portions and additional drawstring means around the neck area;

(c) a hood piece having an inner hood skirt received within said layer interior surface and within said neck area and an outer hood skirt received over said layer exterior surface and over said neck area, said drawstring means being operative to secure said layer in the neck area between said inner and outer hood skirts;

(d) an external air source assembly including a source of pressurized air and a flexible hose connecting the interior of said hood piece to said air source enabling pressurized external air to be fed to an operator wearing said garment;

(e) an inner arm skirt secured within each said arm portion of said garment formed of impermeable fabric and having an upper end periphery secured to said layer interior surface at a position intermediate the length of the said arm portion and extending to the outer extremity thereof;

(f) a glove shaped hand cover secured to and forming an extension of each said inner arm skirt and formed of an air pervious fabric;

(g) an inner leg skirt formed of impermeable fabric secured within each said leg portion of said garment and having an upper end periphery secured to said layer interior surface at a position intermediate the length of said leg portion and extending to the outer extremity thereof; and (h) a boot shaped street shoe cover secured to and forming an extension of each said inner leg skirt, each said street shoe cover having at least a selected portion thereof formed of an air permeable fabric such that when the operator dons work boots over said street shoe covers and fits said work gloves into said arm portions around said inner arm skirts and said work boots into said leg portions around said inner leg skirts, a predetermined volume of said pressurized air is expelled through those selected portions of street shoe covers formed of said air permeable fabric at a predetermined rate to ventilate said garment and prevent ballooning thereof.

2. An air ventilated protective garment as claimed in claim 1 wherein each said boot shaped street shoe cover includes a lower portion formed of an air impervious water repellant fabric.

3. An air ventilated protective garment as claimed in claim 1 wherein said layer includes a waist area and said source of pressurized air mounts on a belt on said waist area.

4. An air ventilated protective garment for an operator working in a hazardous environment, comprising:

(a) an outer impermeable protective layer having portions covering the torso, the arms to the wrists and the legs to the ankles and having an interior surface, an exterior surface and a neck area;

(b) a hood piece secured to said neck area;

(c) an external air source assembly including a source of pressurized air and a flexible hose connecting the interior of said hood piece to said air source enabling pressurized external air to be fed to an operator wearing said garment;

(d) hand covers forming protective extensions of said arm portions; and (e) street shoe covers forming protective extensions of said leg portions and including air permeable sections enabling pressurized air to be expelled therethrough at a volume and rate selected to prevent ballooning of said garment.

5. An air ventilated protective garment as claimed in claim 4 wherein the porosity of said air permeable sections is within the range of 30 to 400 cubic feet per minute per square foot.

6. An air ventilated protective garment as claimed in claim 4 wherein the porosity of said air permeable sections is substantially 100 cubic feet per minute per square foot.

7. An air ventilated protective garment wherein said street shoe covers include below said air permeable sections air impervious sections.

* * * * *